US011220835B2

(12) United States Patent
Tomchak et al.

(10) Patent No.: US 11,220,835 B2
(45) Date of Patent: Jan. 11, 2022

(54) POP-UP CANOPY

(71) Applicant: ShelterLogic Corp., Watertown, CT (US)

(72) Inventors: Michael J. Tomchak, Vandalia, IL (US); Aaron Augustus, Waterbury, CT (US); Pio J. Fusco, Simsbury, CT (US); Christian M. Otis, New Haven, CT (US); George A. Bevilacqua, Orange, CT (US)

(73) Assignee: ShelterLogic Corp., Watertown, CT (US)

( * ) Notice: Subject to any disclaimer, the term of this patent is extended or adjusted under 35 U.S.C. 154(b) by 0 days.

(21) Appl. No.: 17/064,939

(22) Filed: Oct. 7, 2020

(65) Prior Publication Data

US 2021/0102399 A1 Apr. 8, 2021

Related U.S. Application Data

(60) Provisional application No. 62/912,207, filed on Oct. 8, 2019.

(51) Int. Cl.
*E04H 15/50* (2006.01)

(52) U.S. Cl.
CPC ..... *E04H 15/50* (2013.01)

(58) Field of Classification Search
CPC ..... E04H 15/36; E04H 15/44; E04H 15/48; E04H 15/50; E04H 15/505
See application file for complete search history.

(56) References Cited

U.S. PATENT DOCUMENTS 3,810,482 A 5/1974 Beavers
5,274,980 A * 1/1994 Zeigler ..... E04H 15/50 135/123

(Continued)

FOREIGN PATENT DOCUMENTS

CN 202338138 U 7/2012
FR 2849668 A1 * 7/2004 ..... E04H 15/50
GB 1091842 11/1967

OTHER PUBLICATIONS

English translation of FR 2849668 A1 from espacenet.com.*
Examples of prior art pop-ups and tents (7 images) (admitted prior art).

*Primary Examiner* — David R Dunn
*Assistant Examiner* — Danielle Jackson
(74) *Attorney, Agent, or Firm* — Carmody Torrance Sandak & Hennessey LLP

(57) ABSTRACT

An expandable canopy frame including a plurality of legs coupled to each other through a plurality of rib members scissor-type coupled together, with upper ends of certain of the rib members being respectively coupled to top ends of the legs, and lower ends of certain of the rib members being respectively coupled to a slider mechanism slidably mounted to each of the respective legs; a roof assembly for supporting a canopy; and a releasable locking assembly, coupled to the roof assembly, for facilitating the expansion of the expandable canopy into an expanded position and for maintaining the canopy in the expanded position; wherein the expandable canopy in its expanded position has a plurality of sides, and wherein the releasable locking assembly is closer to one of the sides than to the remaining sides of the expandable canopy in its expanded position.

16 Claims, 14 Drawing Sheets

(56) References Cited

U.S. PATENT DOCUMENTS

| | | | | |
|---|---|---|---|---|
| 5,638,853 | A | 6/1997 | Tsai | |
| 6,141,934 | A * | 11/2000 | Zeigler | E04H 15/50 135/121 |
| 6,382,224 | B1 * | 5/2002 | Carter | E04H 15/50 135/114 |
| 6,502,597 | B2 * | 1/2003 | Carter | E04H 15/50 135/131 |
| 6,701,949 | B2 * | 3/2004 | Carter | E04H 15/50 135/131 |
| 6,926,021 | B2 * | 8/2005 | Carter | E04H 15/50 135/131 |
| 6,929,017 | B2 * | 8/2005 | Byun | E04H 15/50 135/131 |
| 7,051,745 | B2 * | 5/2006 | Carter | E04H 15/50 135/131 |
| 7,178,542 | B2 * | 2/2007 | Carter | E04H 15/50 135/131 |
| 7,299,813 | B2 * | 11/2007 | Ochi | E04H 15/50 135/131 |
| 7,448,401 | B2 * | 11/2008 | Carter | E04H 15/50 135/135 |
| 7,571,737 | B2 * | 8/2009 | Jang | E04H 15/50 135/131 |
| 8,387,639 | B2 | 3/2013 | Troxel et al. | |
| 8,919,364 | B1 | 12/2014 | Russell | |
| 9,995,056 | B2 | 6/2018 | Yang | |
| 10,041,272 | B2 * | 8/2018 | Choi | E04H 15/50 |
| 10,662,667 | B2 * | 5/2020 | Stehly | G05D 1/102 |

* cited by examiner

POP-UP CANOPY

This application claims the benefit of U.S. Application Ser. No. 62/912,207 filed on Oct. 8, 2019. The subject matter of said provisional application is incorporated by reference as if fully set forth herein.

BACKGROUND OF THE INVENTION

The present invention relates to pop-up canopies, and more particularly, to a pop-up canopy that is advantageously shaped and constructed to provide advantages over the prior art, including but not limited to, being shaped and constructed so as to facilitate (i) expanding the canopy while not physically positioned (e.g. standing) under the canopy and (ii) viewing when positioned under the expanded canopy by providing an arched rib assembly on one side of the canopy. In a particularly preferred embodiment, the pop-up canopy has a trapezoidal "footprint" as discussed and illustrated herein.

Pop-up canopies are widely known, and include constructions described in CN 202338138; GB 1,091,842; and U.S. Pat. Nos. 3,810,482; 9,995,056; 5,944,044; 8,919,364; and 5,638,853.

Some of these prior art examples, e.g. CN 202338138 and U.S. Pat. Nos. 5,638,853 and 5,944,044 share similar basic features found in many pop-up canopies, including but not limited to a square "footprint," equally dimensioned sides, an equal number of ribs that comprise the scissor-type rib assemblies, and all having the same entry height from each of the four sides of the pop-up canopy. Other tents and/or canopies, such as those illustrated in GB 1,091,842 and U.S. Pat. No. 8,919,364 have a non-square footprint, while still others, such as U.S. Pat. No. 9,995,056, describe different releasable locking mechanisms that facilitates the raising and maintaining of the canopy in its open position. Another very advantageous and utilizable releasable locking mechanism in the present invention is provided in canopies sold by ShelterLogic Corp. under its OnePush trademark, which even provides quick release push pins offering multiple height adjustments for the canopy.

However, the state of the art is deficient in the recognition and the ability to achieve among other things, for example, an easier ability to raise and expand the canopy when not physically standing under the canopy and the providing of a wider and large viewing area when looking out of the canopy when positioned under the canopy in its expanded position.

Thus, it would be desirable to provide an expandable canopy that overcomes the deficiencies of the prior art and achieves the added advantages contemplated herein, all of which are provided by the embodiments disclosed herein.

SUMMARY AND OBJECTIVES OF THE INVENTION

It is thus an objective of the present invention to overcome the perceived deficiencies in the prior art.

For example, it is an advantage and objective of the present invention to provide an expandable canopy that facilitates raising and expanding the canopy when not physically standing under the canopy.

Another advantage and objective of the present invention to provide an expandable canopy that provides a wider and larger viewing area when looking out of the canopy when positioned under the canopy in its expanded position.

Still another advantage and objective of the present invention is to provide a method of expanding and retracting an expandable canopy that provides the advantages and objectives set forth herein.

Other advantages and objectives will be made apparent from the disclosure herein.

Further objects and advantages of this invention will become more apparent from a consideration of the images and figures and ensuing disclosure.

The invention accordingly comprises the features of construction, combination of elements, methods of operation and arrangement of parts which will be exemplified in the construction, illustration and description hereinafter set forth, and the scope of the invention will be indicated in the claims.

Therefore, to overcome the perceived deficiencies in the prior art and to achieve the objects and advantages set forth above and below, preferred embodiments of the present invention are directed to, generally speaking, an expandable canopy frame, comprising one or more features disclosed herein, either individually or in combination with one or more of any other features disclosed herein.

In a particularly preferred embodiment, the present invention is directed to an expandable canopy frame comprising a plurality of legs coupled to each other through a plurality of rib members scissor-type coupled together, with upper ends of certain of the rib members being respectively coupled to top ends of the legs, and lower ends of certain of the rib members being respectively coupled to a slider mechanism slidably mounted to each of the respective legs; a roof assembly for supporting a canopy; and a releasable locking assembly, coupled to the roof assembly, for facilitating the expansion of the expandable canopy into an expanded position and for maintaining the canopy in the expanded position; wherein the expandable canopy in its expanded position has a plurality of sides, and wherein the releasable locking assembly is closer to one of the sides than to the remaining sides of the expandable canopy in its expanded position.

In another preferred embodiment, the present invention is directed to an expandable canopy frame comprising a first leg coupled to a second leg by two (2) scissor couplings comprising four (4) rib members, the second leg coupled to a third leg by two (2) scissor couplings comprising four (4) rib members, the third leg coupled to a fourth leg by four (4) scissor couplings comprising eight (8) rib members, and the fourth leg coupled to the first leg by two (2) scissor couplings comprising four (4) rib members; upper ends of certain of the rib members being respectively coupled to top ends of the legs, and lower ends of certain of the rib members being respectively coupled to a slider mechanism slidably mounted to each of the respective legs; a roof assembly for supporting a canopy; and a releasable locking assembly, coupled to the roof assembly, for facilitating the expansion of the expandable canopy into an expanded position and for maintaining the canopy in the expanded position; wherein when the expandable canopy is in its expanded position the distance between the first leg and the second leg is shorter than the distance between the fourth leg and the third leg; and the rib members coupled between the third leg and the fourth leg provide a clearance to enter the canopy that is higher than the clearance provided by the rib members coupled between any of the other two legs.

BRIEF DESCRIPTION OF THE DRAWINGS

The above set forth and other features of the invention are made more apparent in the ensuing Description of the Preferred Embodiments when read in conjunction with the attached Drawings, wherein.

DETAILED DESCRIPTION OF THE PREFERRED EMBODIMENTS

Reference will now be made to the images and figures herein in connection with the disclosure of preferred embodiments of the expandable canopy and methods for expansion thereof.

For example, reference is first made to FIGS. 1-4, which illustrate preferred embodiments of the expandable canopy frame generally indicated at 10, made in accordance with the present invention in an expanded state.

Figure 1:
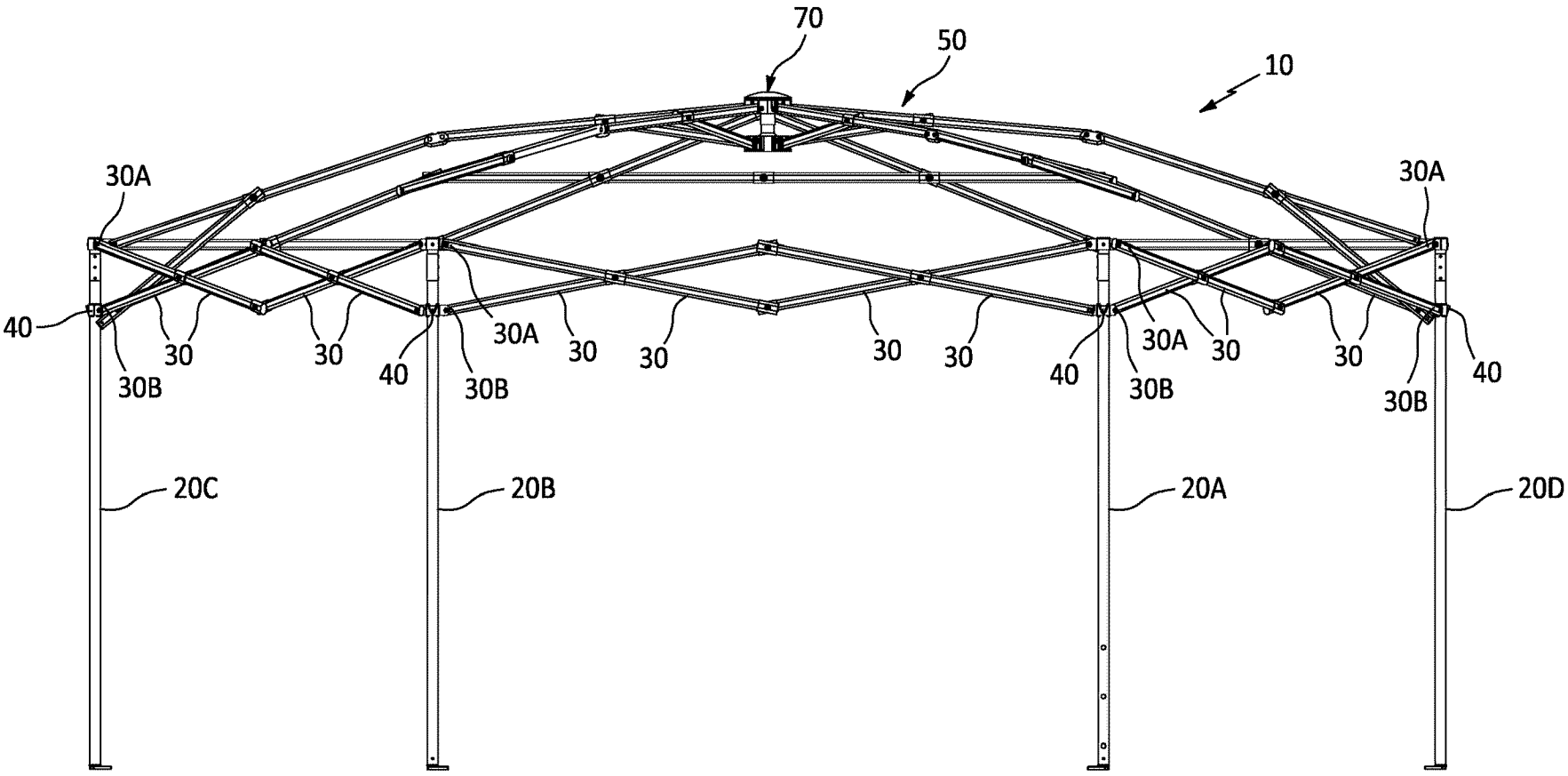
FIGS. 1 and 2 show preferred embodiments of the expandable canopy frame made in accordance with the present invention in an expanded state, with FIG. 1 showing a rear view thereof and FIG. 2 also showing a cover.
Figure 2:
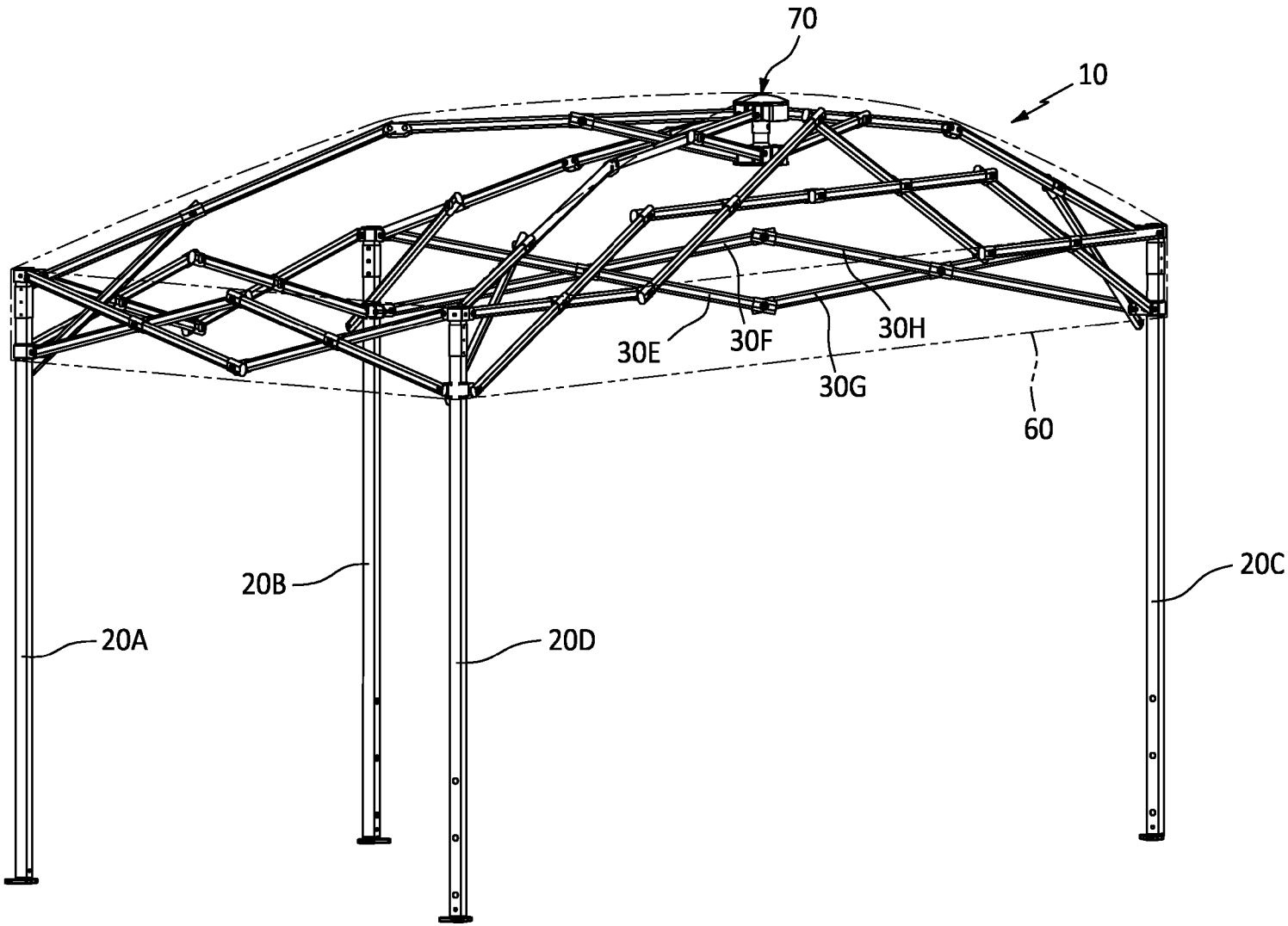

As illustrated therein, a preferred embodiment of the expandable canopy frame 10 of the present invention comprises a plurality of legs 20 coupled to each other through a plurality of rib members 30 scissor-type coupled together, with upper ends 30A of certain of the rib members 30 being respectively coupled to top ends of the legs 20, and lower ends 30B of certain of the rib members 30 being respectively coupled to a slider mechanism 40 slidably mounted to each of the respective legs 20; a roof assembly generally indicated at 50, for supporting a canopy 60; and a releasable locking assembly generally indicated at 70, coupled to the roof assembly 50, for facilitating the expansion of the expandable canopy 60 into an expanded position and for maintaining the canopy in the expanded position (FIG. 2). As can be seen therein and in the remaining figures and disclosure, the expandable canopy frame 10 in its expanded position has a plurality of sides, and the releasable locking assembly 70 is closer to one of the sides than to the remaining sides of the expandable canopy frame 10 in its expanded position.

Figure 3:
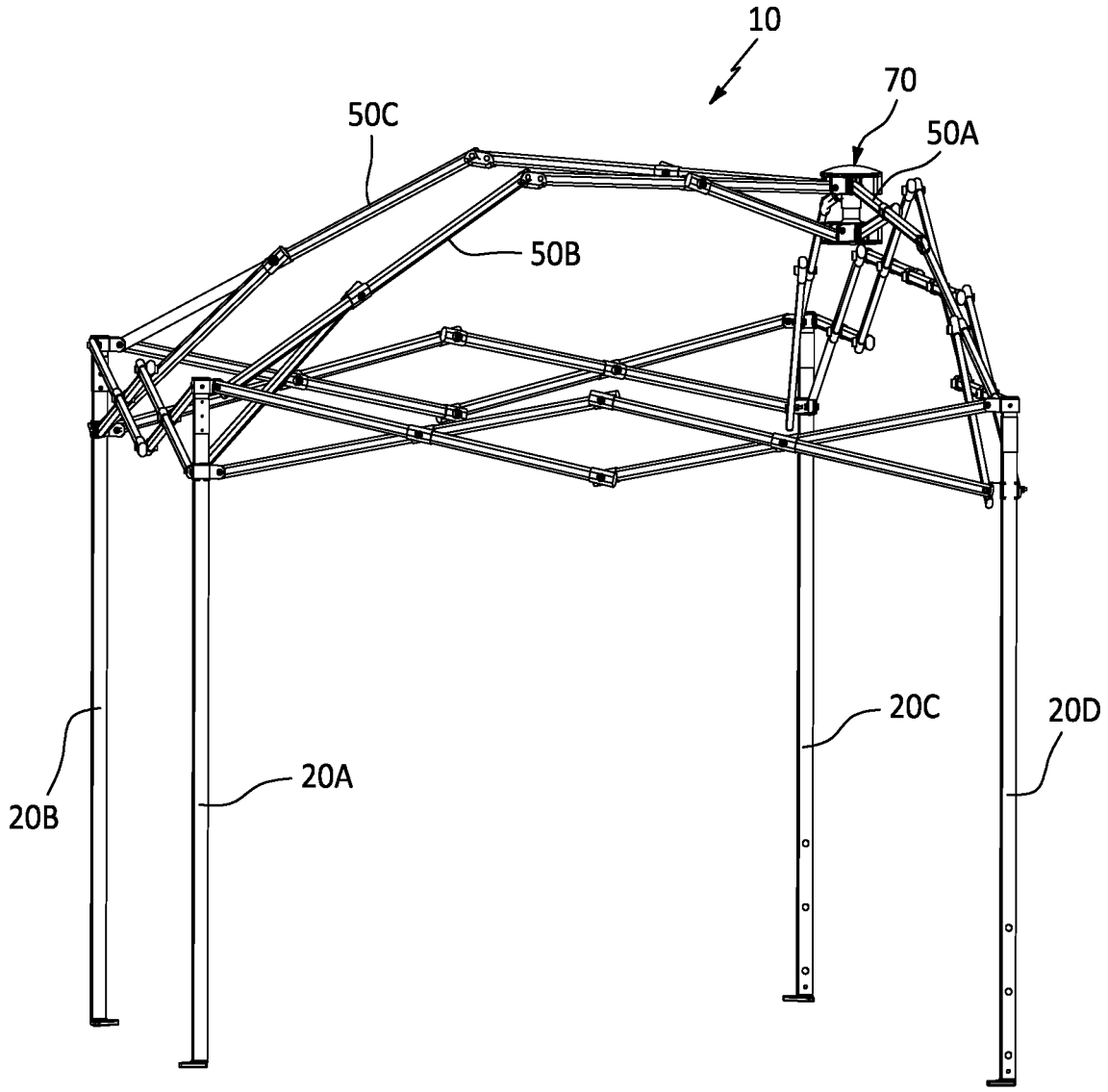
FIG. 3 shows a side profile of a preferred embodiment of the present invention in an expanded state.

The advantageous positioning of the releasable locking assembly 70 can be seen a bit more clearly in the side profile of the expanded canopy frame shown in FIG. 3.

As can be clearly seen in FIG. 3, the releasable locking assembly 70 is accessible by a person standing outside of the footprint created by the expandable canopy frame 10 in its expanded position. In fact, as can be seen, the releasable locking assembly 70 is substantially closer to one of the sides (e.g. the front side) than to the remaining sides of the expandable canopy frame in its expanded position.

In a preferred embodiment, the expandable canopy frame in its expanded position creates an at least essentially (if not close to exactly) trapezoidal footprint having two sides of at least essentially the same length, a back side of a first length and a front side of a length longer than the first length; and wherein the releasable locking assembly 70 is positioned substantially closer to the front side of the expandable canopy frame 10 in its expanded position than to the back side of the expandable canopy frame 10 in its expanded position.

For example, a canopy frame structure of a preferred embodiment comprises four adjustable height vertical legs in a trapezoidal layout. Each leg is connected to an eave that comprises the roof structure.

Figure 5:
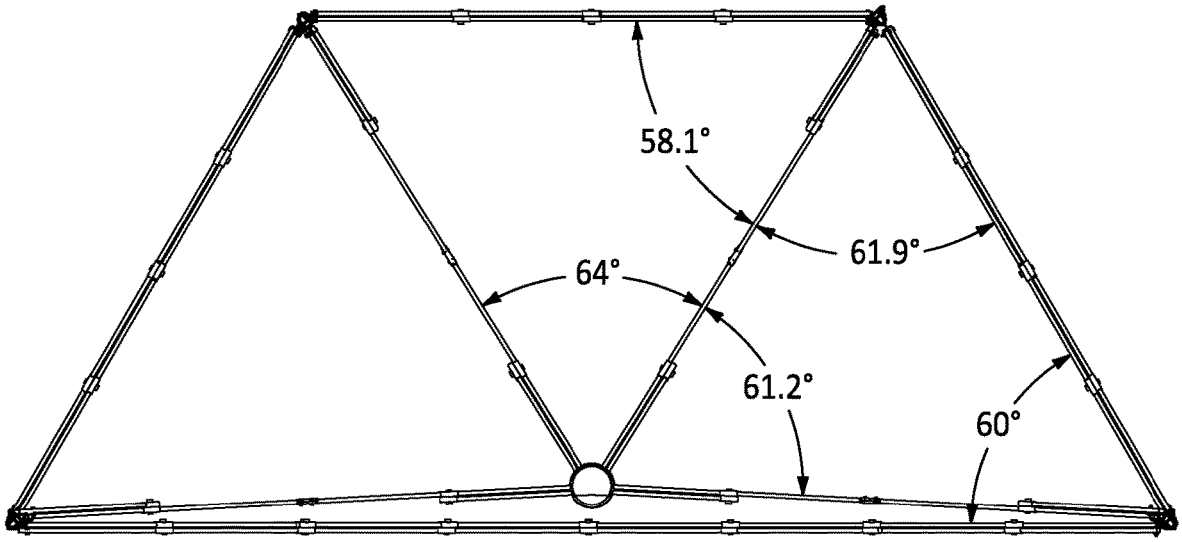
FIG. 5 is a top plan view of a preferred embodiment of the present invention in an expanded state.

As shown in the "top" view of FIG. 5, which shows a preferred layout for the structure, the "front" and "back" sides are parallel to each other, while the two "sides" are angled symmetrically such that the "front" width is greater than the width of the "back."

Continuing to look down, as in FIG. 5, the canopy frame structure appears as three similar sized triangles and a very small, flat triangle area in the front. Preferably, there are five (5) inches between the front scissor area and the center hub. The width varies from 120" on the front side to 60" on the back side.

Figure 4:
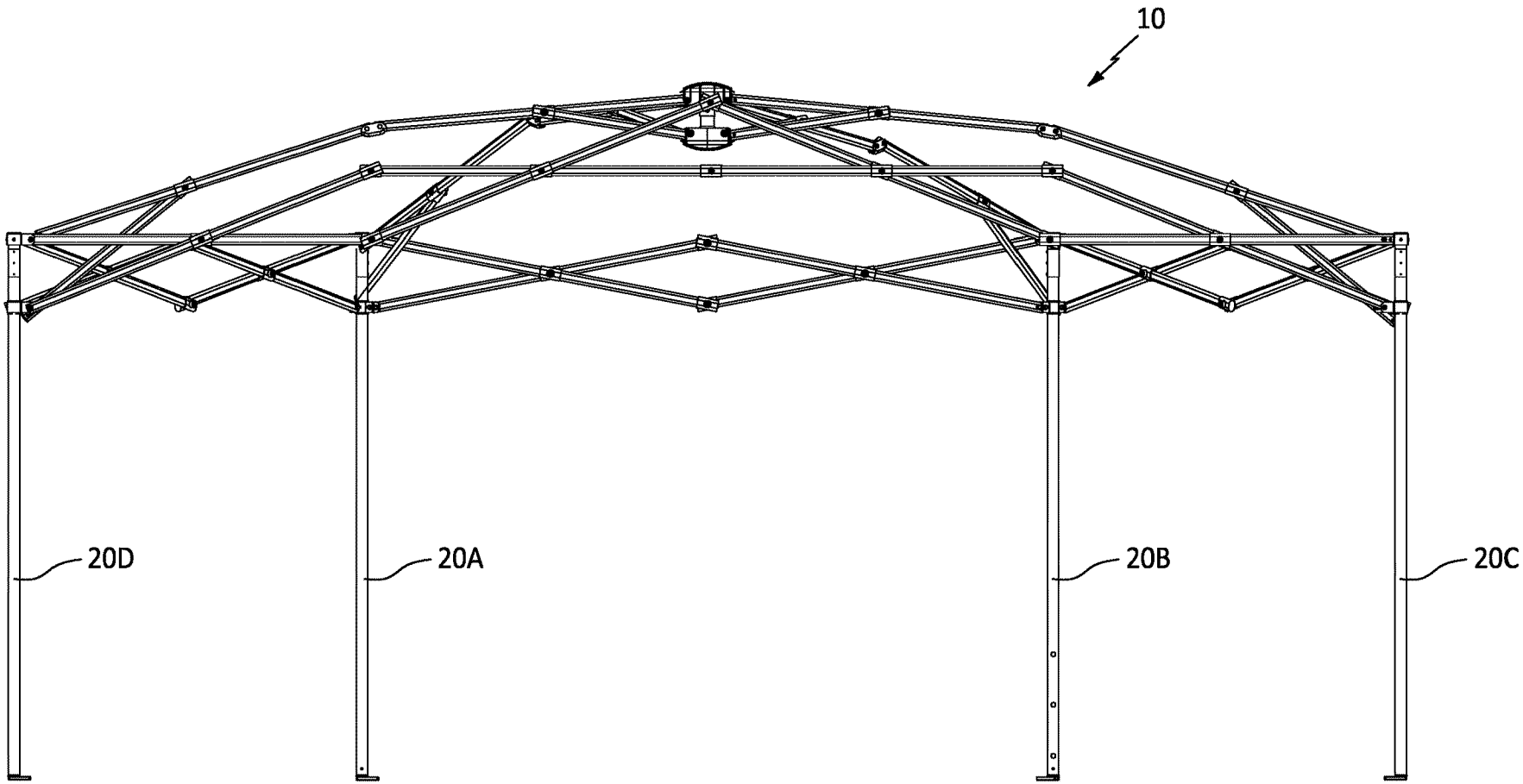
FIG. 4 is a front view of the canopy frame shown in FIGS. 1 and 2.
Figure 6:
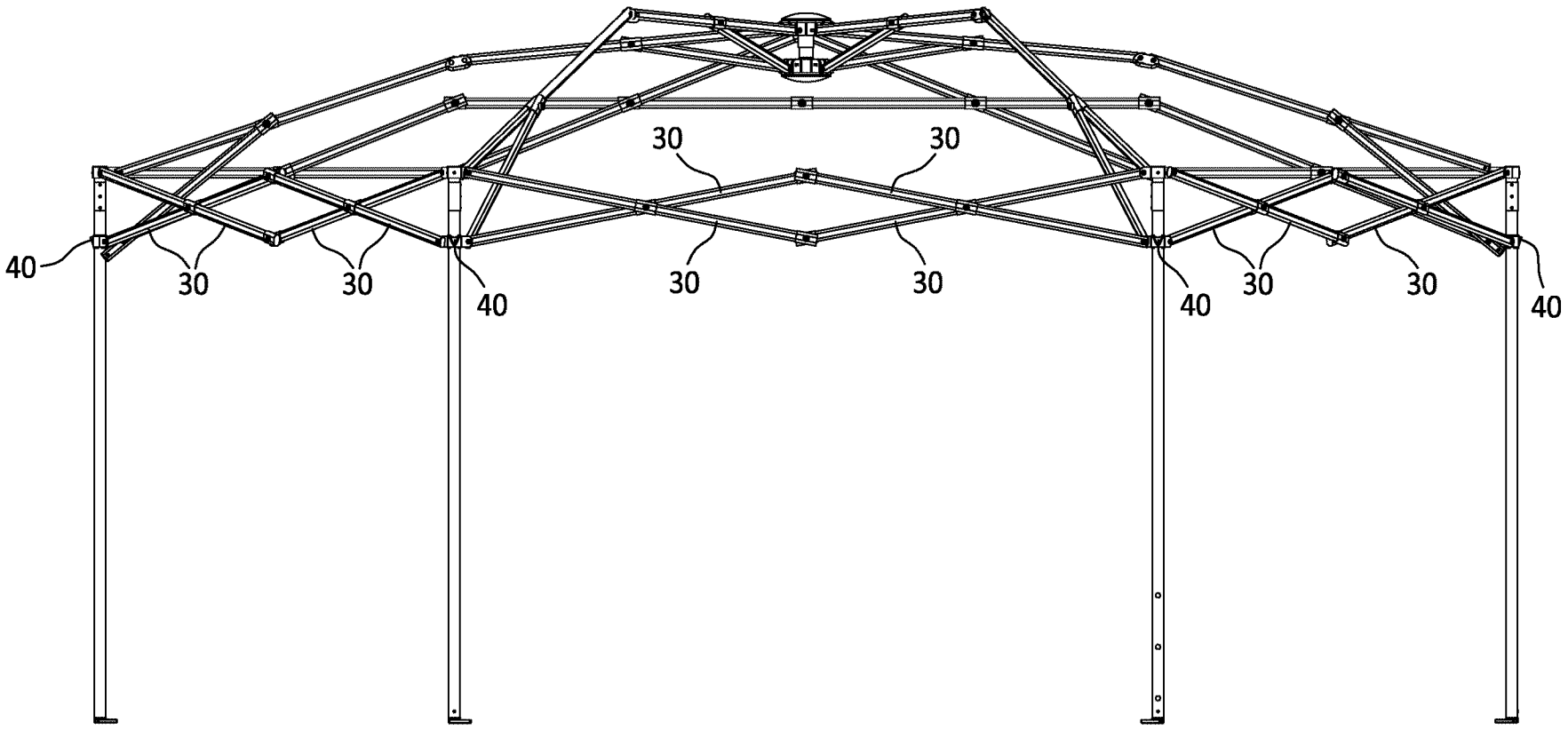
FIG. 6 is a front view of a preferred embodiment of the present invention in an almost fully expanded state.

The "front" view of FIGS. 4 and 6 of a preferred embodiment of an expandable canopy frame 10 of the present invention show the front legs connected to each other with scissor elements, also disclosed herein as scissor-type couplings, comprised of rib members 30. On the legs 20 there are both fixed pivot locations as well as sliding brackets, also referred herein as sliders 40. The parts that make the scissor structure of different overall lengths but require equal center to center holes to have the center of the scissor to be higher than the connections on the vertical legs when in the open position, is shown in FIG. 7.

Figure 7:
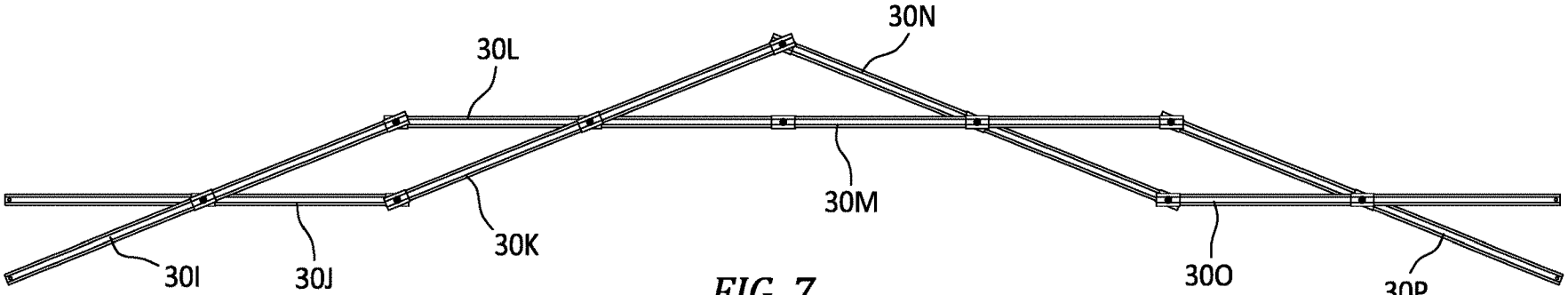
FIGS. 7 and 8 illustrate components of the scissor structure of a preferred embodiment of the present invention.

The construction shown in FIG. 7 creates an arc that spans the front face of the structure.

Figure 8:
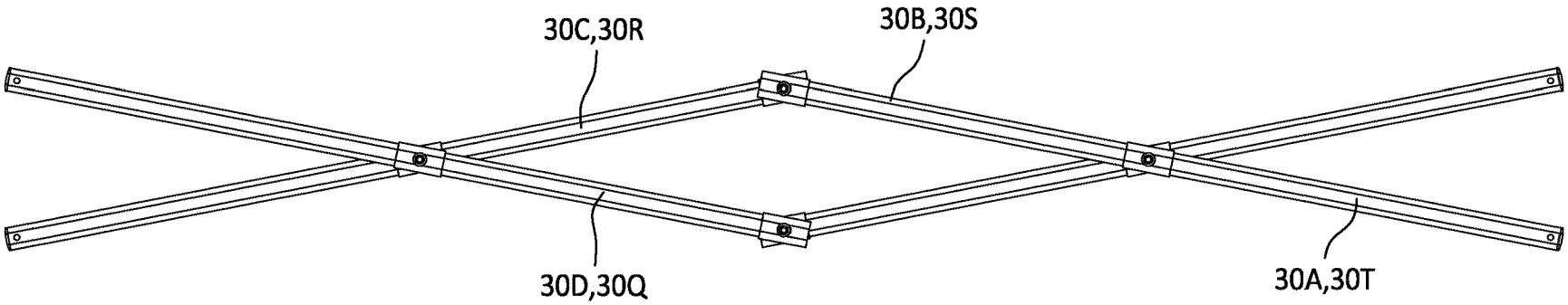

As illustrated in the Figures, the front scissor structure has four x-shaped elements that combine to form the full front area. The other three sides have only two x-shaped elements. FIG. 8 shows a preferred construction of the side and back side scissor areas.

The center to center and overall lengths of each part is identical. Together, this is what may be referred to as "4-2-2 configuration."

Figure 9:
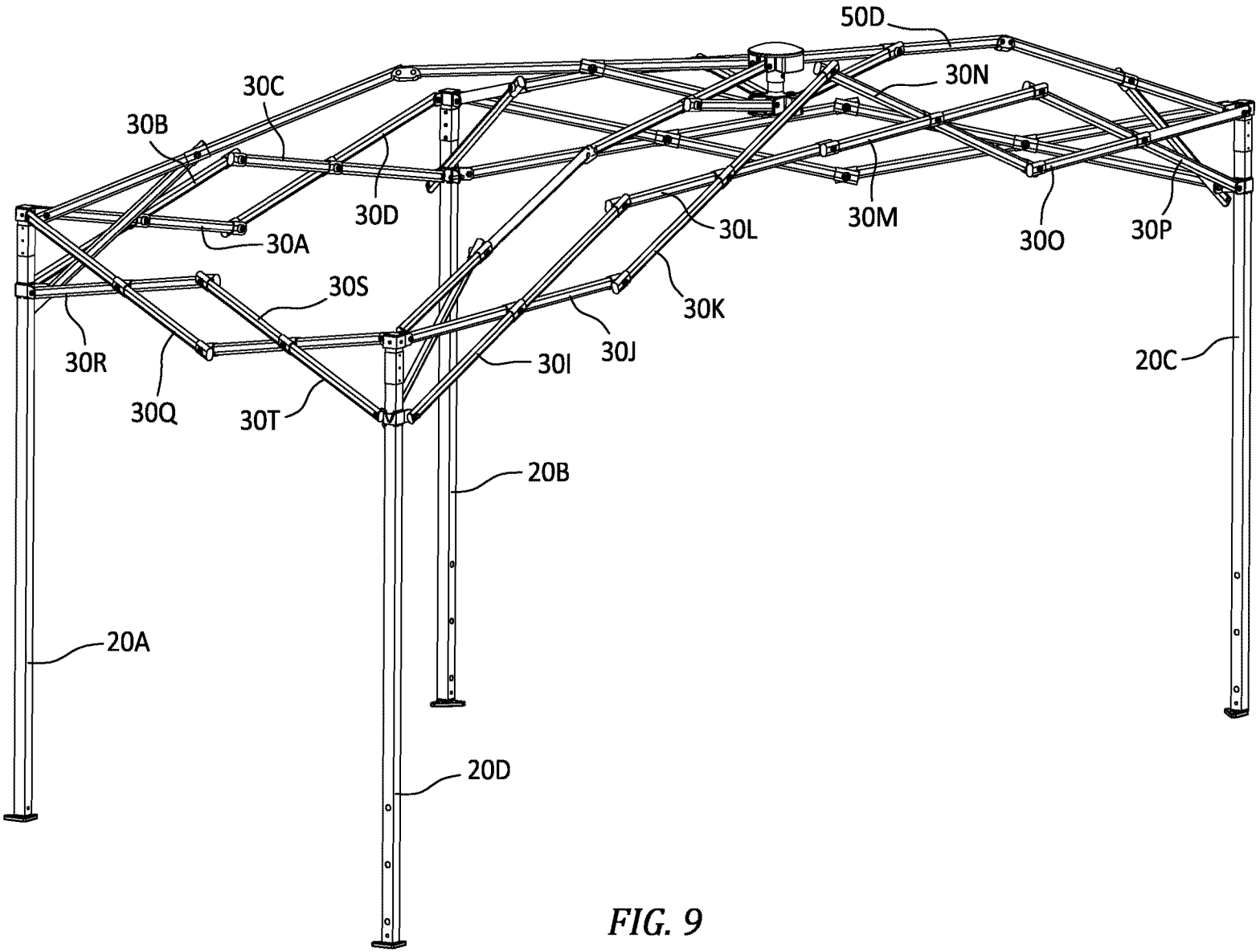
FIG. 9 also shows a preferred embodiment of the present invention in an expanded state from an angle different than that shown in FIG. 1.

FIG. 9 shows a different angle of an expanded canopy frame 10 constructed in accordance with preferred embodiments of the present invention.

As can thus be seen, a preferred embodiment of the present invention comprises four (4) legs 20 coupled to each other through the plurality of the scissor coupled rib members 30, wherein the first leg 20A is coupled to the second leg 20B by four (4) rib members 30A, 30B, 30C, 30D forming two (2) scissor couplings, the second leg 20B is coupled to the third leg 20C by four (4) rib members 30E, 30F, 30G, 30H forming two (2) scissor couplings (see FIG. 2), the third leg 20C is coupled to the leg 20D by eight (8) rib members 30I, 30J, 30K, 30L, 30M, 30N, 30O, 30P forming four (4) scissor couplings (see FIG. 9), and the fourth leg 20D is coupled to the first leg 20A by four (4) rib members 30Q, 30R, 30S, 30T forming two (2) scissor-couplings (see FIG. 9); wherein when the expandable canopy frame 10 is in its expanded position (i) the distance between the first leg 20A and the second leg 20B is shorter than the distance between the fourth leg 20D and the third leg 20C; and (ii) the releasable locking assembly 70 is closer to a line formed between the third leg 20C and the fourth leg 20D than a line formed between the first leg 20A and second leg 20B.

Again, the figures show the advantageous feature of the releasable locking assembly 70 being accessible by a person standing outside of the footprint created by the expandable canopy frame 10 in the expanded position. In particular, the releasable locking assembly 70 is substantially closer to the line formed between the third leg 20C and the fourth leg 20D than the line formed between the first leg 20A and second leg 20B. As discussed herein, the releasable locking assembly 70 can be as close as five (5) inches from the line formed between the third leg 20C and the fourth leg 20D; i.e. where viewing the canopy structure from the top as illustrated in FIG. 5.

As also illustrated in the figures, an expandable canopy frame 10 of a preferred embodiment comprises a first leg 20A coupled to a second leg 20B by two (2) scissor couplings comprising four (4) rib members 30A, 30B, 30C, 30D, the second leg 20B coupled to a third leg 20C by two (2) scissor couplings comprising four (4) rib members 30E, 30F, 30G, 30H, the third leg 20C coupled to a fourth leg 20D by four (4) scissor couplings comprising eight (8) rib members 30I, 30J, 30K, 30L, 30M, 30N, 30O, 30P, and the fourth leg 20D coupled to the first leg 20A by two (2) scissor couplings comprising four (4) rib members 30Q, 30R, 30S, 30T; upper ends of certain of the rib members 30A being respectively coupled to top ends of the legs, and lower ends of certain of the rib members 30B being respectively coupled to a slider mechanism 40 slidably mounted to each of the respective legs 20; a roof assembly 50 for supporting a canopy 60; and a releasable locking assembly 70, coupled to the roof assembly 50, for facilitating the expansion of the expandable canopy frame 10 into an expanded position and for maintaining the canopy 60 in the expanded position; wherein when the expandable canopy frame 10 is in its expanded position (i) the distance between the first leg 20A and the second leg 20B is shorter than the distance between the fourth leg 20D and the third leg 20C; and (ii) the rib members 30 coupled between the third leg 20C and the fourth leg 20D provide a clearance to enter the canopy frame 10 that is higher than the clearance provided by the rib members 30 coupled between any of the other two legs.

Providing this advantageous feature is the preferred construction design wherein the expandable canopy frame 10 in its expanded position has (i) a distance between the first leg 20A and the second leg 20B that is shorter than the distance between the fourth leg 20D and the third leg 20C when the expandable canopy frame 10 is in its expanded position; and (ii) two (2) of the rib members of the rib members forming the four (4) scissor couplings between the third leg 20C and the fourth leg 20D being colinearly aligned. In this way, the rib members forming the four (4) scissor couplings between the third leg 20C and the fourth leg 20D are (and appear to be) arched relative to the rib members between the first leg 20A and second leg 20B, the second leg 20B and third leg 20C, and the first leg 20A and fourth leg 20D. Turning now to features of the roof assembly, the roof assembly is preferably comprised of elements that are attached to each of the vertical legs, as exemplified in FIG. 10.

Figure 10:
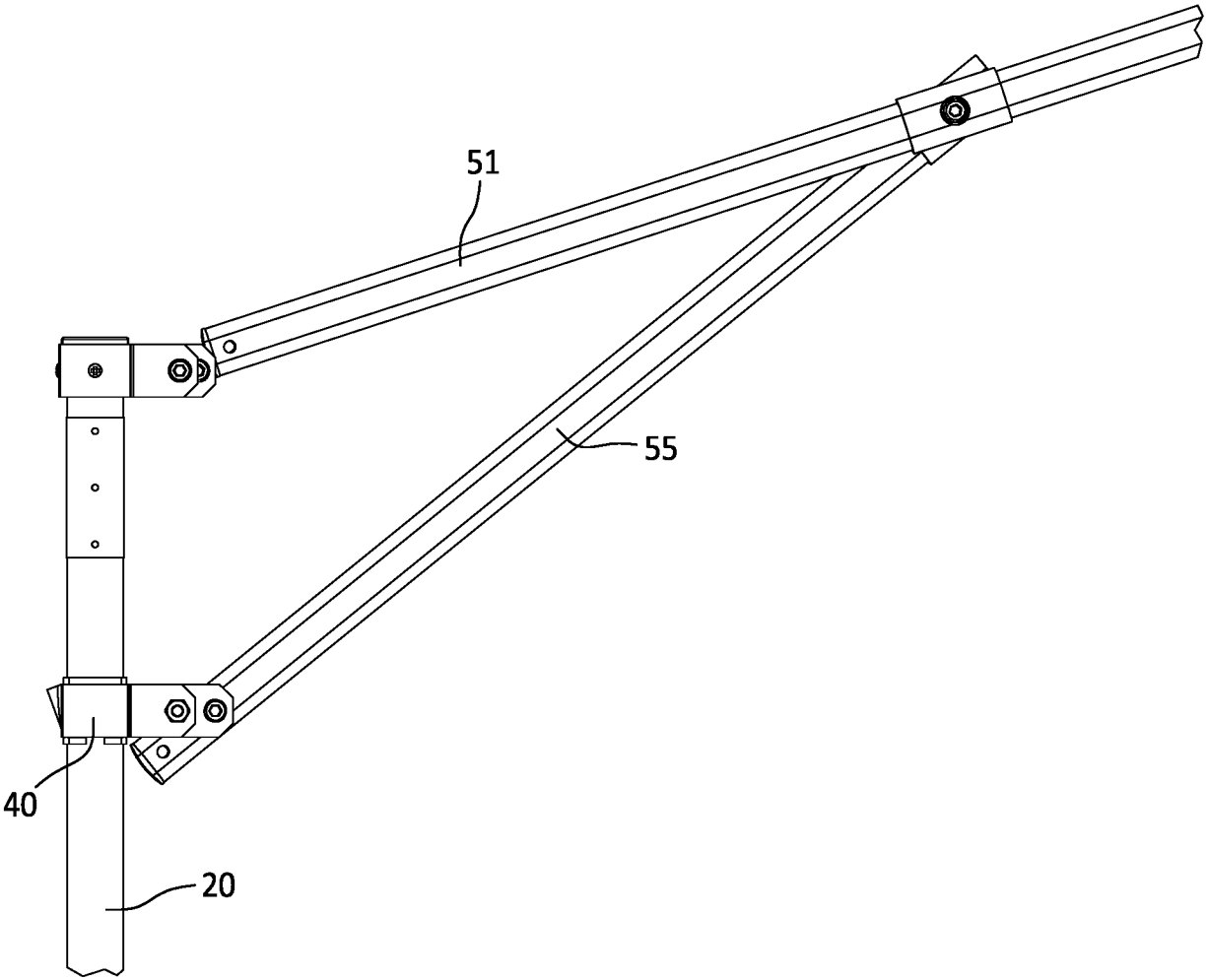
FIGS. 10, 11 and 12 illustrate components of a preferred embodiment of a roof assembly in accordance with the invention.
Figure 11:
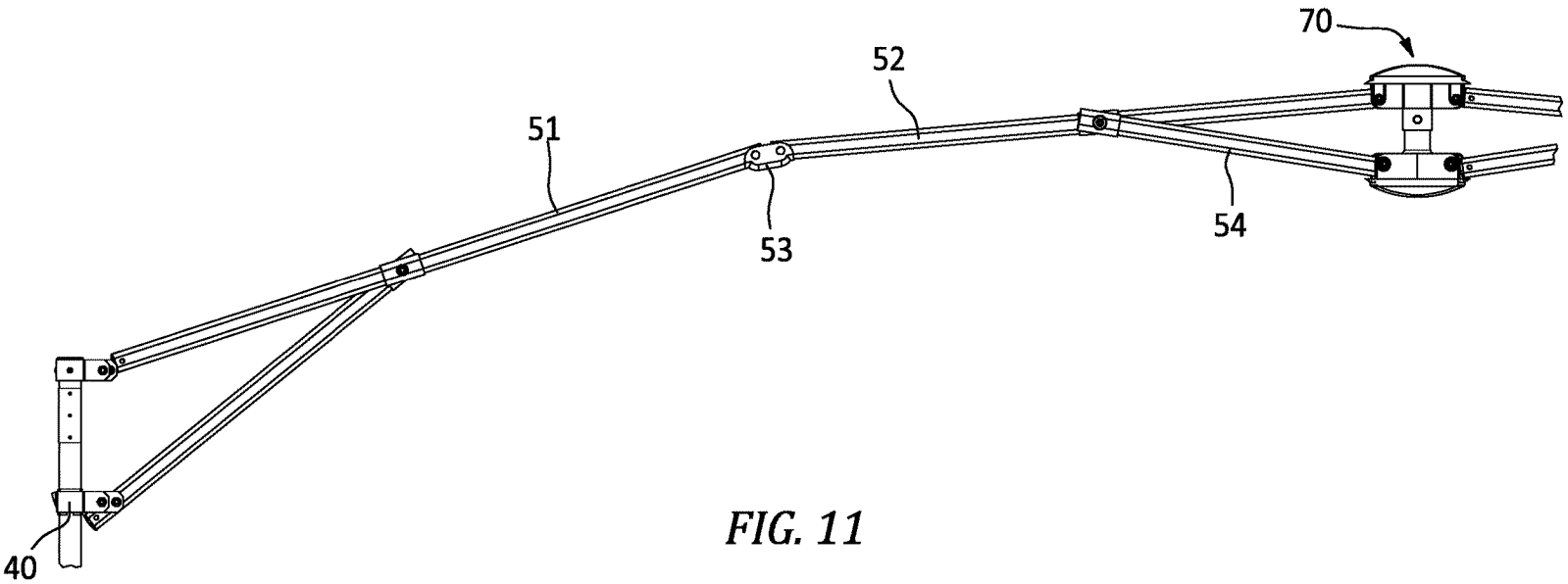
Figure 13:
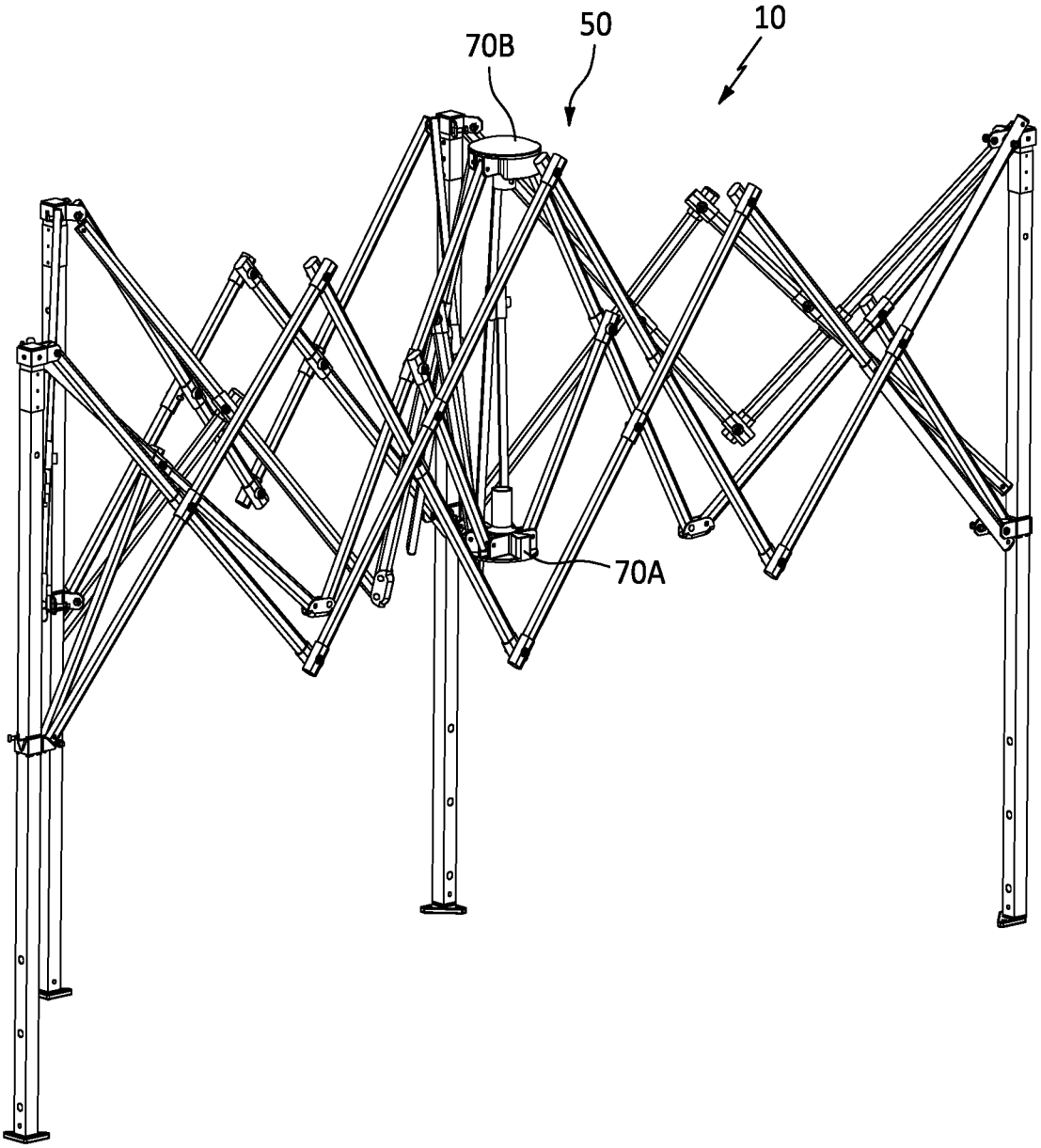
FIGS. 13, 14, and 15 also illustrate, among other features of the preferred embodiments, features of the canopy frame in a partially collapsed state.
Figure 14:
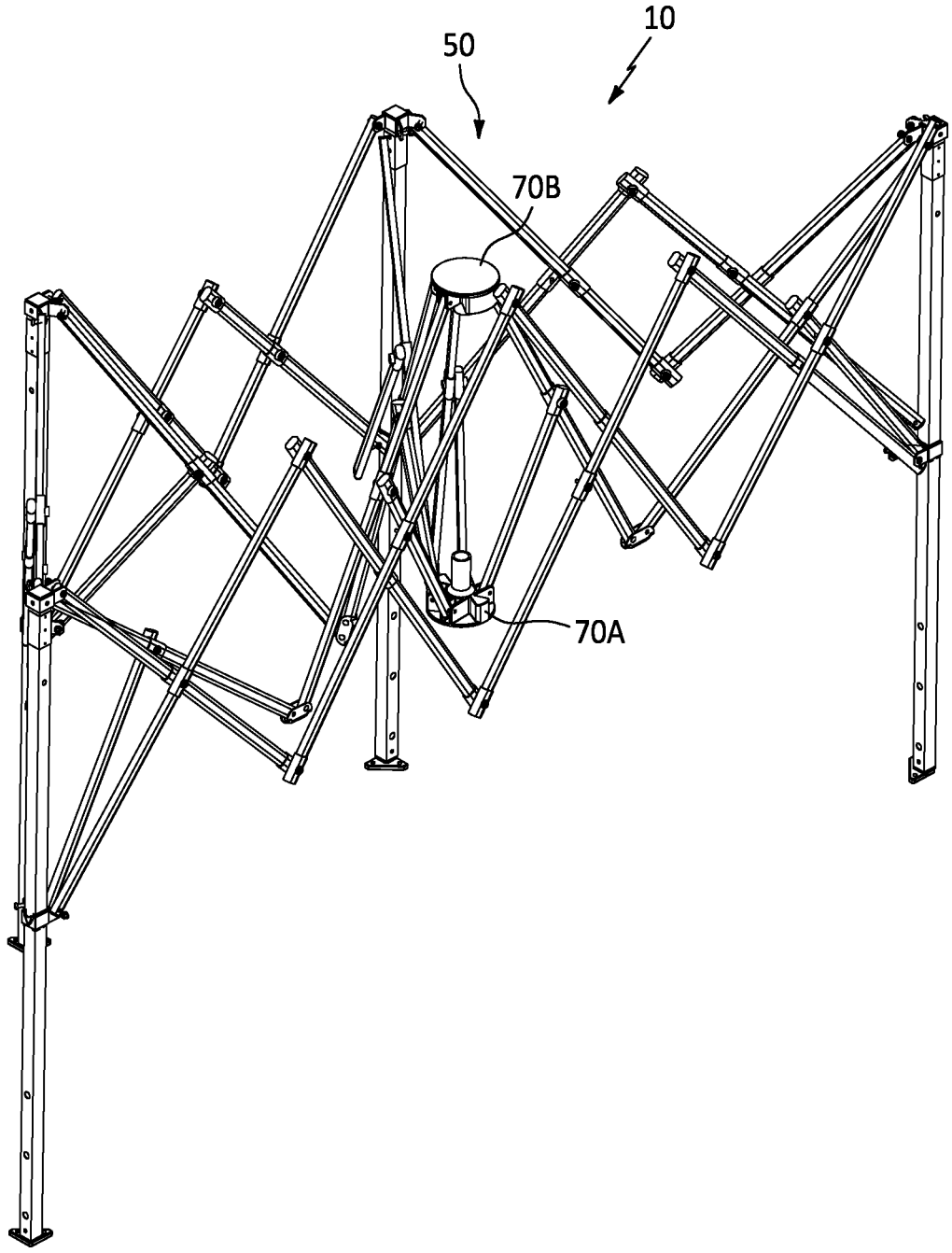
Figure 15:
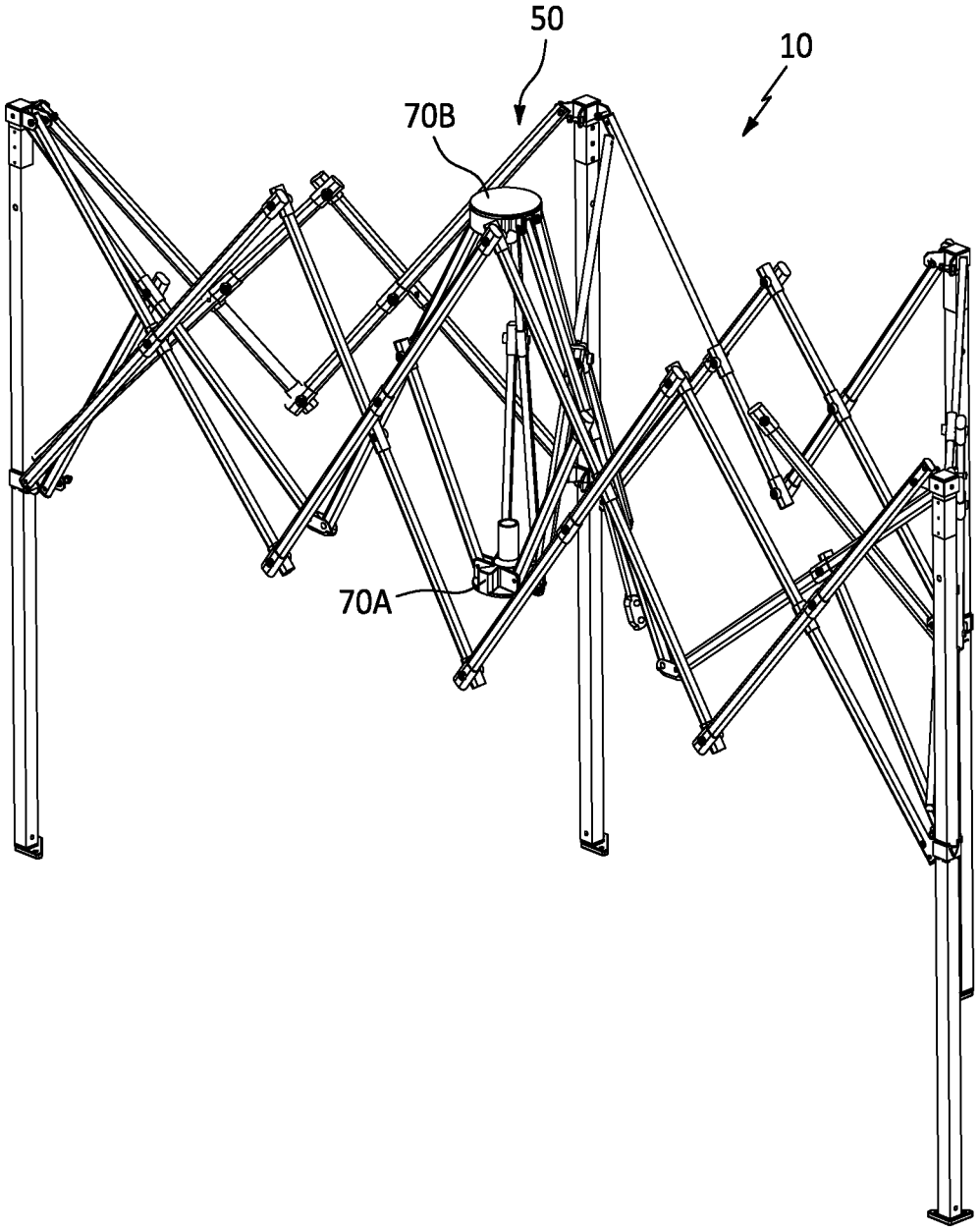

As shown in FIG. 10, there are both fixed pivot locations as well as a separate element 55 connected to a sliding bracket 40 (the same as the scissor sliding bracket). Each roof element is preferably hinged along its length to allow folding in a closed position on the interior of the leg and scissor elements, as shown in FIGS. 13-15. The front leg attachments have an angle that moves the "center" of the roof structure to sit behind and above the center of the front arc scissors structure. FIG. 11 shows one of the four assemblies that comprise the roof structure. The 'sliding joint" is also referred herein as a "slider."

Figure 12:
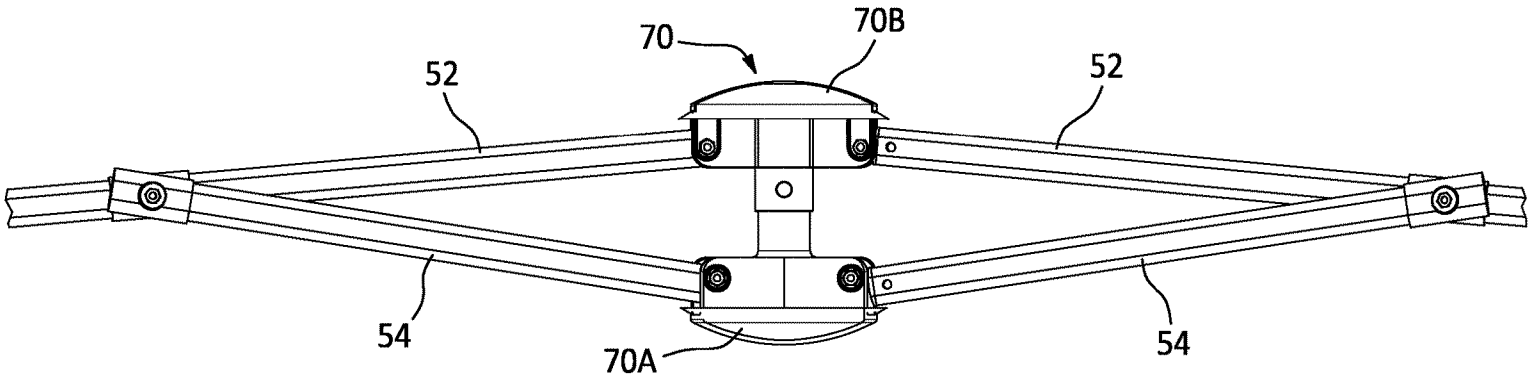

The structure is held in the open position to the "hub" located at the center of the roof structure. Each of the eave elements contain smaller elements on pivots that connect to a lower hub 70A while the roof elements connect directly to the upper hub 70B. The two parts of the hub assembly, as illustrated in FIG. 12, are disconnectable and fold along with the rest of the structure. In the open position, the lower hub 70A cylinder fits into a larger diameter cylinder in the upper hub 70B. The lower hub 70A contains a tube spring pin that engages into a hole on the upper hub cylinder.

The location of this tube pin places the short elements in a position that allows the structure to be held in the open position without the assistance from locking on the legs. FIGS. 11 and 12 show the open position of the canopy structure. This opening can be accomplished by using one hand to press up on the bottom hub 70A. The pushing up on the hub 70A will cause the structure to unfold and remain in this position with the positive locking feature mentioned above. As can be seen in the bracket shown in FIG. 12, the hub is used to reduce lateral movement of the arc scissor area (FIG. 7).

FIGS. 13, 14, and 15 also illustrate, among other features of the preferred embodiments, features of the canopy frame in a partially collapsed state.

That is, and as discussed above, a preferred embodiment of the releasable locking assembly 70 comprises a hub assembly comprising an upper hub 70B and a lower hub 70A, wherein the lower hub 70A is insertable into and maintained in the upper hub 70B when the expandable canopy frame 10 is in its expanded position. Preferably, the lower hub 70A comprises the tube spring pin that engages into a hole on upper hub 70B for releasable coupling therein.

As also illustrated, in a preferred embodiment, the roof assembly 50 comprises four (4) roof rib assemblies 50A, 50B, 50C, 50D (see FIGS. 3, 9, and 11), each roof rib assembly preferably comprising two (2) ribs 51, 52 coupled to each other through a rib joint 53. The four (4) roof rib assemblies are coupled at one side to the hub assembly and at the other end, are respectively coupled to the sliders 40 to which the scissor coupled rib members are coupled. Thus, during both expansion and collapsing of the canopy frame 10, the roof assembly 50 collapses and expands with the footprint of the canopy frame structure itself. The upper hub 70B is coupled to the respective first ends of four (4) roof rib assemblies 50A, 50B, 50C, 50D. In addition, the roof assembly 50 preferably comprises four (4) lower hub support ribs 54, each lower hub support rib 54 having (i) a first end pivotably coupled to one of the ribs 52 of each roof rib assembly 50A, 50B, 50C, 50D and (ii) a second end of which is coupled to the lower hub 70A, wherein the pivoting of the lower hub support ribs 54 about the respective roof assembly ribs permits the bringing together of the lower hub 70A towards the upper hub 70B for insertion and releasable locking therein.

Figure 16:
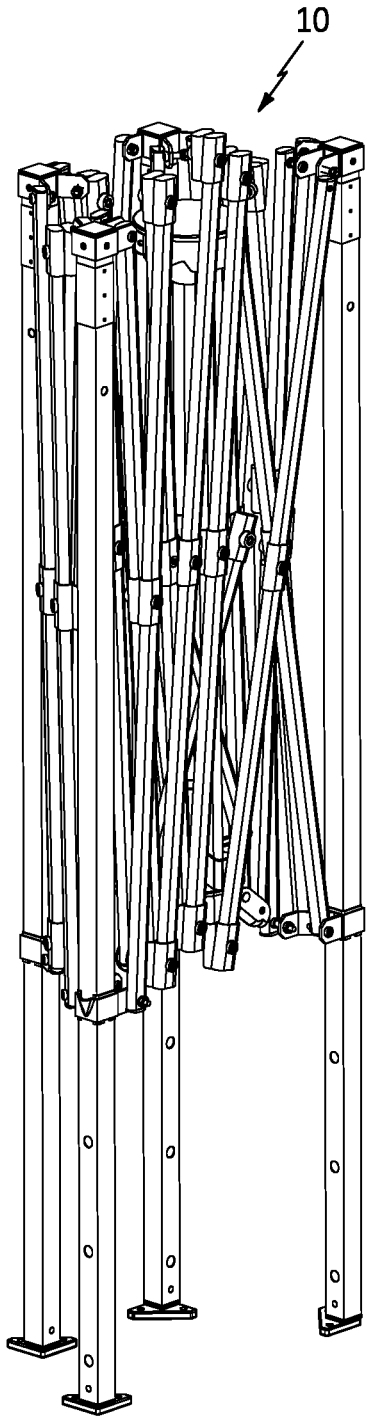
FIG. 16 illustrates the compactness achieved by preferred embodiments of a canopy frame of the present invention when in the collapsed position.

For completeness, FIG. 16 illustrates the compactness achieved by the canopy frame 10 of the present invention when in the collapsed position.

And, as disclosed herein, a preferred footprint created when the canopy frame 10 is expanded is a trapezoid. It should be understood that the present invention contemplates, includes and hereby explicitly discloses and includes a cover for covering the roof assembly, which should be understood and well known in the art.

It should be understood that the dimensions provided herein are preferred dimensions, but manufacturing and/or other tolerances are anticipated, so small variations in the foregoing are expected. Therefore, the present invention discloses the preferred "footprint" as a trapezoid, but small differences in manufacturing tolerances may not provide for an exact trapezoid, but one that is within 95% of a trapezoid.

Also, it should be understood that reference to the releasable locking assembly being closer to one of the sides than to the remaining sides of the expandable canopy in its expanded position is intended to mean that the releasable locking assembly is not centered as it is on all e.g. "square" footprint popups. Here, it has been disclosed that the releasable locking assembly 70 is preferably about five (5) inches from the line created by the front legs 20C, 20D as shown in FIG. 5, when looking down as in FIG. 5, but even closer distances or somewhat further distances are contemplated. By example and not limitation, certainly any distance eighteen (18) inches or less would be considered "substantially closer" to one of the sides than to the remaining sides of the expandable canopy in its expanded position. That is, within eighteen (18) inches of the opening, as illustrated in FIG. 5, would be considered "substantially closer." Certainly one (1) to five (5) inches are also contemplated herein, wherein the preferred distance from the front of the canopy frame is five (5) inches plus/minus an inch.

While the present invention has been described with respect to preferred embodiments, those skilled in the art will readily appreciate that various changes and/or modifications can be made to the invention without departing from the spirit or scope of the invention.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It should also be understood that the following claims are intended to cover all of the generic and specific features of the invention described herein and all statements of the scope of the invention that as a matter of language might fall therebetween.

What is claimed is:

1. An expandable canopy frame comprising:

a plurality of legs coupled to each other through a plurality of rib members scissor-type coupled together, with upper ends of certain of the rib members being respectively coupled to top ends of the legs; and a slider mechanism slidably mounted to each of the respective legs, wherein each slider is coupled to at least one lower end of a rib member;

a roof assembly for supporting a canopy; and a releasable locking assembly, coupled to the roof assembly, for facilitating the expansion of the expandable canopy frame into an expanded position and for maintaining the canopy frame in the expanded position;

wherein the expandable canopy frame in its expanded position creates an at least substantially trapezoidal footprint; and wherein the expandable canopy frame in its expanded position has a plurality of sides, and wherein the releasable locking assembly is closer to one of the sides than to the remaining sides of the expandable canopy frame in its expanded position.

2. The expandable canopy frame as claimed in claim 1, wherein the releasable locking assembly is accessible by a person standing outside of the footprint created by the expandable canopy frame in its expanded position.

3. The expandable canopy frame as claimed in claim 1, wherein the releasable locking assembly is substantially closer to one of the sides than to the remaining sides of the expandable canopy frame in its expanded position.

4. The expandable canopy frame as claimed in claim 1, wherein the expandable canopy frame in its expanded position has two sides of at least essentially the same length, a back side of a first length and a front side of a length longer than the first length; and wherein the releasable locking assembly is positioned substantially closer to the front side of the expandable canopy frame in its expanded position than to the back side of the expandable canopy frame in its expanded position.

5. The expandable canopy frame as claimed in claim 1, wherein the releasable locking assembly comprises a hub assembly comprising an upper hub and a lower hub, wherein the lower hub is insertable into and maintained in the upper hub when the expandable canopy frame is in its expanded position.

6. The expandable canopy frame as claimed in claim 5, wherein the lower hub comprises a tube spring pin that engages into a hole on the upper hub for releasable coupling therein.

7. The expandable canopy frame as claimed in claim 5, wherein the roof assembly comprises four roof rib assemblies, each roof rib assembly comprising two ribs coupled to each other through a rib joint.

8. The expandable canopy frame as claimed in claim 1, wherein the footprint created is a trapezoid.

9. The expandable canopy frame as claimed in claim 1, including a canopy for covering the roof assembly.

10. An expandable canopy frame comprising:

four legs coupled to each other through a plurality of rib members scissor-type coupled together, with upper ends of certain of the rib members being respectively coupled to top ends of the legs; and a slider mechanism slidably mounted to each of the respective legs, wherein each slider is coupled to at least one lower end of a rib member;

wherein the four legs are coupled to each other through the plurality of the scissor coupled rib members, wherein:

the first leg is coupled to the second leg by four of the plurality of rib members forming two scissor couplings, the second leg is coupled to the third leg by four of the plurality of rib members forming two scissor couplings, the third leg is coupled to the fourth leg by eight of the plurality of rib members forming four scissor couplings, and the fourth leg is coupled to the first leg by four of the plurality of rib members forming two scissor-couplings;

a roof assembly for supporting a canopy; and a releasable locking assembly, coupled to the roof assembly, for facilitating the expansion of the expandable canopy frame into an expanded position and for maintaining the canopy frame in the expanded position;

wherein when the expandable canopy frame is in its expanded position:

the distance between the first leg and the second leg is shorter than the distance between the fourth leg and the third leg; and the releasable locking assembly is closer to a line formed between the third leg and the fourth leg than a line formed between the first and second leg.

11. The expandable canopy frame as claimed in claim 10, wherein the releasable locking assembly is accessible by a person standing outside of a footprint created by the expandable canopy frame in the expanded position.

12. The expandable canopy frame as claimed in claim 10, wherein the releasable locking assembly is substantially closer to the line formed between the third leg and the fourth leg than the line formed between the first and second leg.

13. An expandable canopy frame comprising:

a first leg coupled to a second leg by two scissor couplings comprising four rib members, the second leg coupled to a third leg by two scissor couplings comprising four rib members, the third leg coupled to a fourth leg by four scissor couplings comprising eight rib members, and the fourth leg coupled to the first leg by two scissor couplings comprising four rib members;

upper ends of certain of the rib members being respectively coupled to top ends of the legs; and a slider mechanism slidably mounted to each of the respective legs wherein each slider is coupled to at least one lower end of a rib member;

a roof assembly for supporting a canopy; and a releasable locking assembly, coupled to the roof assembly, for facilitating the expansion of the expandable canopy frame into an expanded position and for maintaining the canopy frame in the expanded position;

wherein when the expandable canopy frame is in its expanded position:

the distance between the first leg and the second leg is shorter than the distance between the fourth leg and the third leg; and the rib members coupled between the third leg and the fourth leg provide a clearance to enter the canopy frame that is higher than the clearance provided by the rib members coupled between any of the other two legs.

14. The expandable canopy frame as claimed in claim 13, wherein two of the rib members of the rib members forming the four scissor couplings between the third leg and the fourth leg being colinearly aligned;

whereby the rib members forming the four scissor couplings between the third leg and the fourth leg appear to be arched relative to the rib members between the first leg and second leg, the second leg and third leg, and the first leg and fourth leg.

15. The expandable canopy frame as claimed in claim 13, wherein a footprint created is a trapezoid.

16. An expandable canopy frame comprising:

a plurality of legs coupled to each other through a plurality of rib members scissor-type coupled together, with upper ends of certain of the rib members being respectively coupled to top ends of the legs; and a slider mechanism slidably mounted to each of the respective legs, wherein each slider is coupled to at least one lower end of a rib member;

a roof assembly for supporting a canopy; and a releasable locking assembly, coupled to the roof assembly, for facilitating the expansion of the expandable canopy frame into an expanded position and for maintaining the canopy frame in the expanded position;

wherein the expandable canopy frame in its expanded position has a plurality of sides, and wherein the releasable locking assembly is closer to one of the sides than to the remaining sides of the expandable canopy frame in its expanded position;

wherein the releasable locking assembly comprises a hub assembly comprising an upper hub and a lower hub, wherein the lower hub is insertable into and maintained in the upper hub when the expandable canopy frame is in its expanded position;

wherein the roof assembly comprises four roof rib assemblies, each roof rib assembly comprising two ribs coupled to each other through a rib joint; and wherein the roof assembly comprises four lower hub support ribs, each lower hub support rib having (i) a first end pivotably coupled to one of the ribs of each roof rib assembly and (ii) a second end of which is coupled to the lower hub, wherein the pivoting of the lower hub support ribs about the respective roof assembly ribs permits the bringing together of the lower hub towards the upper hub for insertion and releasable locking therein.

* * * * *